US006347195B1

(12) United States Patent
Saiki et al.

(10) Patent No.: US 6,347,195 B1
(45) Date of Patent: Feb. 12, 2002

(54) IMAGE FORMING APPARATUS AND CARTRIDGE DISCRIMINATING APPARATUS

(75) Inventors: Mikio Saiki; Masami Sakuma; Toru Isosu, all of Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/645,336

(22) Filed: Aug. 25, 2000

(30) Foreign Application Priority Data

Sep. 14, 1999 (JP) ..... 11-260823

(51) Int. Cl.[7] ..... G03G 15/00
(52) U.S. Cl. ..... 399/12
(58) Field of Search ..... 399/12, 25

(56) References Cited

U.S. PATENT DOCUMENTS 4,839,691 A * 6/1989 Tagawa et al. ..... 399/12
4,974,020 A * 11/1990 Takamatsu et al. ..... 399/12
5,835,817 A * 11/1998 Bullock et al. ..... 399/12 X
6,023,594 A * 2/2000 Okiyama et al. ..... 399/12

FOREIGN PATENT DOCUMENTS

JP A-7-152307 6/1995
JP A-9-185311 7/1997

* cited by examiner

*Primary Examiner*—Fred L Braun
(74) *Attorney, Agent, or Firm*—Oliff & Berridge, PLC

(57) ABSTRACT

An apparatus for discriminating different kinds of cartridges includes a first discriminating unit which discriminates a positional relation between a fitting portion provided at a predetermined position at a side of the cartridge and a fitted portion provided at a predetermined position at a side of the image forming apparatus on a fitting surface when in a loaded state to determine characteristics of the cartridge and characteristics of the image forming apparatus. The apparatus includes a second discriminating unit which discriminates mechanical compatibility by defining a positional relation between the fitting portion and the fitted portion in the loaded state in a fitting direction according to the characteristics of the cartridge and the characteristics of the image forming apparatus.

10 Claims, 14 Drawing Sheets

IMAGE FORMING APPARATUS AND CARTRIDGE DISCRIMINATING APPARATUS

BACKGROUND OF THE INVENTION

1. Field of the Invention

The present invention relates to an image forming apparatus such as a copying machine, a printer, a facsimile machine, or a combined machine of these, and more particularly to a discriminating technique of a cartridge detachably attached to a main body of the image forming apparatus.

2. Description of the Related Art

Conventionally, there is widely known an image forming apparatus in which part of its structural components is made a cartridge so that it can be easily exchanged and handled. For example, in the image forming apparatus of an electrophotographic system, there is known an apparatus in which an image supporting body, an electrifying unit, a developing unit, a cleaning unit, and the like are integrated into one structure and are made a cartridge, or only a toner of powder is made a cartridge. A user exchanges the cartridge and uses it.

As the cartridge, in order to assure the picture quality or life of the image forming apparatus, it is desirable to use the cartridge whose structure and specification conform to the main body of the image forming apparatus, a so-called authorized product.

On the other hand, actually, a cartridge made by a so-called third party, which has compatibility with the cartridge of the authorized product, is put on the market. The structure and specification of the cartridge made by the third party do not necessarily conform to the main body of the image forming apparatus, and according to circumstances, the expected picture quality or life can not be achieved, and the merits of a user or maker can be damaged.

Then, conventionally, there have been proposed techniques to discriminate the conformity between the main body of the image forming apparatus and the cartridge. For example, Japanese Patent Unexamined Publication No. Hei. 7-152307 proposes a technique to electrically discriminate the kinds of cartridges through ON/OFF of a switch. Japanese Patent Unexamined Publication No. Hei. 9-185311 proposes a technique to discriminate the kinds of cartridges through a rugged pattern. And then, it is devised such that the kinds of cartridge are discriminated by these techniques, and if an unsuitable cartridge is loaded in the main body of the image forming apparatus, the image forming apparatus can not be used.

However, when the techniques are applied and the mechanical compatibility of many cartridges is judged, there are problems that the electric circuit becomes complicated or the rugged pattern becomes large. On the other hand, in recent years, although the manufacture of image forming apparatuses through OEM (Original Equipment Manufacturing) is popular, since there is a request by a partner maker to make the cartridges of the respective rival makers incompatible with each other, the kinds of cartridges to be discriminated are increasing.

SUMMARY OF THE INVENTION

The present invention has been made in view of such circumstances and provides an image forming apparatus which can discriminate the kinds of many cartridges through a small and simple structure.

That is, according to an aspect of the present invention, an image forming apparatus includes an image forming apparatus main body, a cartridge detachably attached to the image forming apparatus main body, and a discriminating unit which discriminates the mechanical compatibility between the cartridge and the image forming apparatus main body, in which the discriminating unit includes a first discriminating unit which discriminates the mechanical compatibility by defining a positional relation between a fitting portion provided at a predetermined position at a side of the cartridge and a fitted portion provided at a predetermined position at a side of the image forming apparatus main body in a loaded state on a fitting surface according to characteristics of the cartridge and characteristics of the image forming apparatus main body, and a second discriminating unit which discriminates the mechanical compatibility by defining a positional relation between the fitting portion and the fitted portion in the loaded state in a fitting direction according to the characteristics of the cartridge and the characteristics of the image forming apparatus main body.

As a mode of the first discriminating unit of the image forming apparatus, the first discriminating unit may include plural first concave portions provided at the side of the image forming apparatus main body, a switch button provided as the fitted portion in one of the plural first concave portions according to the characteristics of the image forming apparatus main body, and a first convex portion provided as the fitting portion at the side of the cartridge and being capable of fitting to one of the plural first concave portions provided at the side of the image forming apparatus main body according to the characteristics of the cartridge. Although the switch button can be provided at the side of the cartridge, since the structure of the cartridge is complicated and the cost is raised, it is preferable to provide the switch button at the side of the image forming apparatus.

Besides, in the first concave portions and the first convex portion as described above, the first concave portions are slit holes of long length in an attaching/detaching direction of the image forming apparatus main body and the cartridge, and the first convex portion is a projecting portion of long length in the attaching/detaching direction of the image forming apparatus main body and the cartridge.

By constructing the image forming apparatus in this way, with the attaching/detaching operation between the image forming apparatus main body and the cartridge, the first convex portion and the first concave portion become easy to fit. Further, the first convex portion and the first concave portion become difficult to damage at the time of attachment/detachment.

Besides, in the present invention, the second discriminating unit includes a main body side second concave-convex portion provided at the side of the image forming apparatus main body according to the characteristics of the image forming apparatus main body, and a cartridge side second concave-convex portion provided at the side of the cartridge according to the characteristics of the cartridge, and at least in a case where the characteristics of the image forming apparatus main body and the cartridge are coincident with each other, both the second concave-convex portions are fitted to each other.

According to whether the main body side second concave-convex portion and the cartridge side second concave-convex portion are fitted or not, two modes are defined with respect to the positional relations between the fitting portion and the fitted portion in the fitting direction in the loaded state, and it is possible to discriminate the mechanical compatibility between the image forming apparatus main body and the cartridge.

Incidentally, the statement "at least in a case where the characteristics of the image forming apparatus main body and the cartridge are coincident with each other, both the second concave-convex portions are fitted to each other" means that even in the case where both the characteristics are not coincident with each other, there can be a case where both the second concave-convex portions are fitted. Even in that case, by the first discriminating unit, it is possible to discriminate the mechanical compatibility between the image forming apparatus main body and the cartridge.

In the second discriminating unit as described above, the main body side second concave-convex portion may be structured such that it can be freely retracted in a concave-convex direction with respect to the cartridge and is urged to the side of the cartridge.

By constructing the image forming apparatus in this way, even in the case where the main body side second concave-convex portion and the cartridge side second concave-convex portion are not fitted to each other, since the main body side second concave-convex portion is retracted to the side of the image forming apparatus main body against urging force, forcible force is not applied to both the second concave-convex portions, and there is no fear to damage both the concave-convex portions, the cartridge, and the image forming apparatus main body. In the case where the main body side second concave-convex portion and the cartridge side second concave-convex portion are fitted to each other, the urging force assists so that they become easy to fit, and when they are once fitted to each other, they become difficult to disengage.

Besides, in the second discriminating unit as described above, the plural first concave portions and the main body side second concave-convex portion may be integrally constructed.

By constructing the image forming apparatus in this way, in the case where the first concave portion and the first convex portion are fitted to each other, the urging force assists so that they become easy to fit, and when they are once fitted to each other, they become difficult to disengage.

Besides, the present invention relates to a cartridge of an image forming apparatus loaded in the image forming apparatus.

BRIEF DESCRIPTION OF THE DRAWINGS

A preferred embodiment of the present invention will be described in detail based on the following figures, wherein.

DETAILED DESCRIPTION OF THE PREFERRED EMBODIMENT

A preferred embodiment of the present invention will be described below with reference to the drawings.

FIGS. 1A to 1D and FIGS. 2A to 2D are views for schematically explaining an example of a discriminating method by the first discriminating unit and the second discriminating unit, respectively, in the embodiment. In these drawings, a portion indicated by oblique lines descending toward the right indicates the fitting portion, and a portion indicated by oblique lines descending toward the left indicates the fitted portion.

Figure 1A:
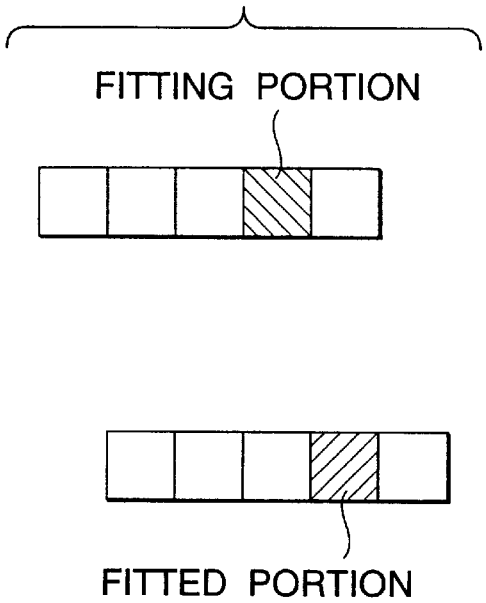
FIGS. 1A to 1D are views for explaining the function of a first discriminating unit.
Figure 1B:
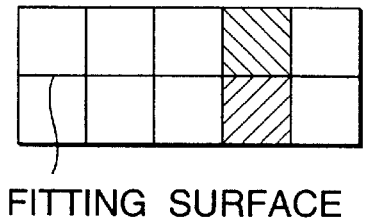
Figure 1C:
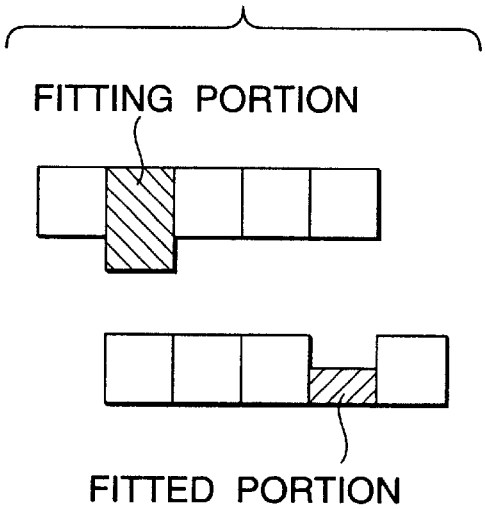
Figure 1D:
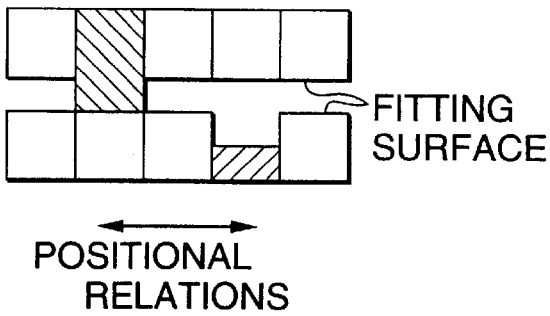

Both FIGS. 1A and 1C show the state before the cartridge is loaded in the image forming apparatus main body, and both FIGS. 1B and 1D show the state (loaded state) where the cartridge is loaded in the image forming apparatus main body. Besides, both FIGS. 1A and 1B show an example in which the fitting portion provided at the side of the cartridge and the fitted portion provided at the side of the image forming apparatus main body are constructed flat, and both FIGS. 1C and 1D show an example in which the fitting portion and the fitted portion are constructed with a convex portion and a concave portion.

In FIG. 1A, there are five positions where the fitting portion can be provided at the side of the cartridge, and in this case, the fitting portion is provided at the second position from the right. Besides, there are five positions where the fitted portion can be provided at the side of the image forming apparatus main body, and in this case, the fitted portion is provided at the second position from the right. When the cartridge is loaded in the image forming apparatus main body, as shown in FIG. 1B, it is understood that the positional relations between the fitting portion and the fitted portion on the fitting surface are equal to each other.

On the other hand, in FIG. 1C, there are five positions where the fitting portion can be provided at the side of the cartridge, and in this case, the fitting portion is provided at the fourth position from the right. Besides, the fitted portion is provided at the second position from the right at the side of the image forming apparatus main body. When the cartridge is loaded in the image forming apparatus main body, as shown in FIG. 1C, it is understood that the positional relations between the fitting portion and the fitted portion on the fitting surfaces are different from each other (the positions where the fitting portion and the fitted portion are provided are apart from each other by the amount of two positions).

The first discriminating unit defines such positional relations between the fitting portion and the fitted portion on the fitting surface. Incidentally, the number of the fitting surfaces may be regarded as only one (see FIG. 1B) or may be regarded as two (see FIG. 1C).

Figure 2A:
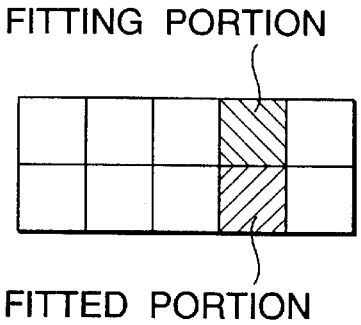
FIGS. 2A to 2D are views for explaining the function of a second discriminating unit.
Figure 2B:
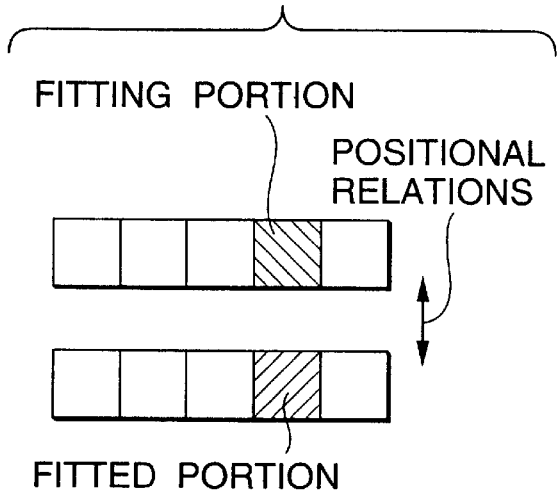
Figure 2C:
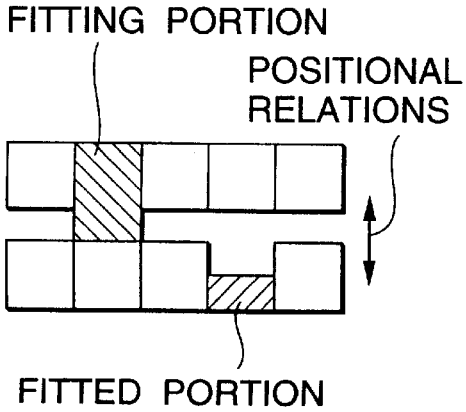
Figure 2D:
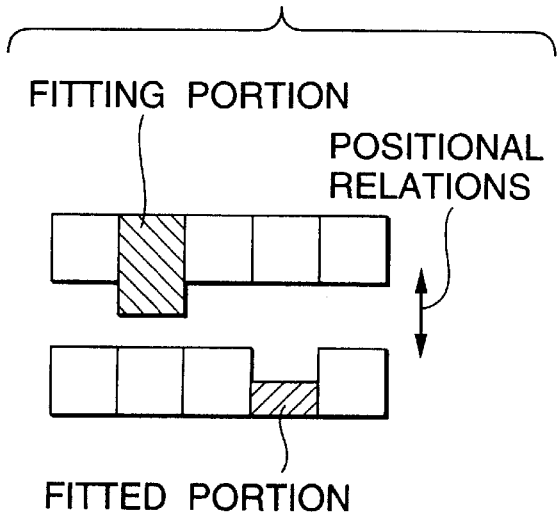

All of FIGS. 2A to 2D show the states where the cartridge is loaded in the image forming apparatus main body. Both FIGS. 2A and 2B show examples in which the fitting portion provided at the side of the cartridge and the fitted portion provided at the side of the image forming apparatus main body are structured flat, and both FIGS. 2C and 2D show examples in which the fitting portion and the fitted portion are constructed with a convex portion and a concave portion.

Although both FIGS. 2A and 2B show modes in which the positional relations between the fitting portion and the fitted portion on the fitting surface are equal to each other according to the first discriminating unit, the positional relations of the fitting portion and the fitted portion in a fitting direction are different between FIG. 2A and FIG. 2B. That is, it is seen that the fitting portion and the fitted portion are in contact with each other in FIG. 2A, while they are separate from each other in FIG. 2B.

On the other hand, although both FIGS. 2C and 2D show modes in which the positional relations between the fitting portion and the fitted portion on the fitting surface are different from each other according to the first discriminating unit, the positional relations of the fitting portion and the fitted portion in the fitting direction are different between FIG. 2C and FIG. 2D. That is, the positional relations of the fitting portion and the fitted portion are relatively close in the fitting direction in FIG. 2C, while they are relatively distant in FIG. 2D.

The second discriminating unit defines such positional relations between the fitting portion and the fitted portion in the fitting direction.

In the present invention, by the function of such first and second discriminating units, it is possible to discriminate the kinds of many cartridges through the small and simple structure. For example, in the example shown in FIGS. 1A to 1D, (by the first discriminating unit), on the basis of the conformity or nonconformity of the positional relations between the fitting portion and the fitted portion on the fitting surface, it is possible to only discriminate one suitable cartridge among five kinds of cartridges for one image forming apparatus main body. On the other hand, when the second discriminating unit is provided in addition to the first discriminating unit, on the basis of the conformity and nonconformity of the positional relations between the fitting portion and the fitted portion on the fitting surface, and the distance of the positional relations in the fitting direction, it is possible to discriminate one suitable cartridge among ten kinds of cartridges for one image forming apparatus main body.

That is, when the number of states of the positional relations between the fitting portion and the fitted portion on the fitting surface defined by the first discriminating unit is N, and the number of states of the positional relations between the fitting portion and the fitted portion in the fitting direction defined by the second discriminating unit is M, it is possible to discriminate one suitable state (state where the fitting portion and the fitted portion are fitted) of the cartridge and the image forming apparatus main body among the total N×M states.

This means that even if the number of process cartridges to be recognized is increased, the necessity of reassembling of an electric circuit becomes less. Incidentally, in this example, although the number of states of the positional relations on the fitting surface is 5, and the number of states of the positional relations in the fitting direction is 2, each may be another plural number.

There is no limitation to the image forming apparatus to which the present invention can be applied. For example, as its image forming system, the invention can be applied to image forming apparatuses of various systems, such as an electrophotographic system, inkjet system, and thermal transfer ribbon system, and as the kind of the image forming apparatus, the invention can be applied to the image forming apparatus such as a printer, facsimile machine, copying machine, or a combined machine of these.

Besides, there is no limitation to the cartridge detachably loaded in the image forming apparatus main body. For example, a toner cartridge in the inside of which a powder toner is filled, a process cartridge in which part or all of functional components around an image supporting body are united, and the like can be enumerated for the image forming apparatus of the electrophotographic system. An ink cartridge in the inside of which liquid ink is filled, a cartridge integrated with an ink head in addition to ink, and the like can be enumerated for the image forming apparatus of the inkjet system. Besides, a ribbon cartridge in the inside of which a ribbon is housed, and the like can be enumerated for the image forming apparatus of the thermal transfer ribbon system.

The characteristics of the image forming apparatus main body or the characteristics of the cartridge include technical characteristics, for example, the kind of toner filled in the cartridge and the kind of the developing unit of the image forming apparatus main body, and further, even if the technical characteristics of the image forming apparatus main body and the cartridge are the same, commercial characteristics, for example, the difference between makers of OEM supplied party, is also included.

Figure 3A:
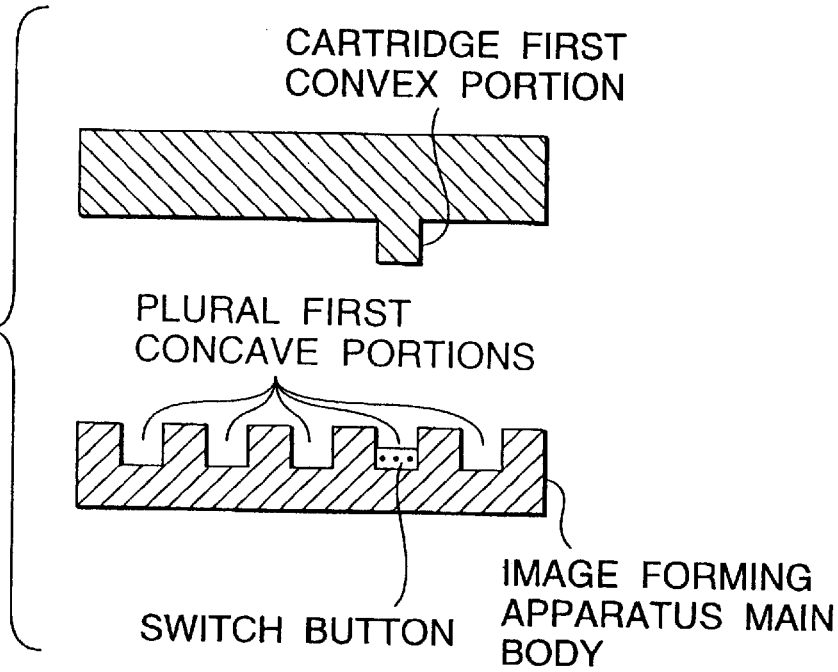
FIGS. 3A to 3C are views for explaining fitting between a first convex portion and a first concave portion.
Figure 3B:
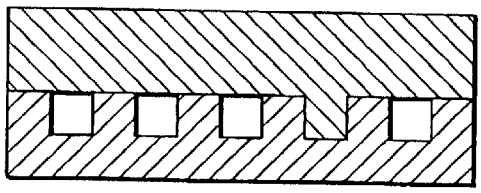
Figure 3C:
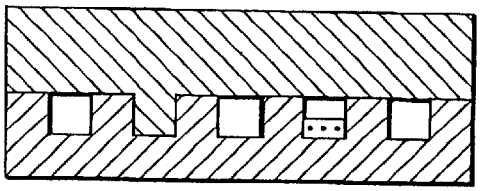

FIGS. 3A to 3C are views for explaining the mode of the first discriminating unit. FIG. 3A shows a state before the cartridge is loaded in the image forming apparatus. FIG. 3B shows a state where the cartridge is loaded in the image forming apparatus from the state shown in FIG. 3A. The first convex portion according to the characteristics of the cartridge is fitted in the first concave portion according to the characteristics of the image forming apparatus main body, and the first convex portion presses the switch button in the first concave portion. That is, from the fact that this switch button is pressed, it is possible to recognize that the characteristics of the cartridge and the image forming apparatus are coincident with each other.

On the other hand, although FIG. 3C shows a state where the cartridge is loaded in the image forming apparatus similarly to FIG. 3B, the first convex portion according to the characteristics of the cartridge is not fitted in the first concave portion corresponding to the characteristics of the image forming apparatus main body, and the first convex portion does not press the switch button. That is, from the fact that the switch button is not pressed, it is possible to recognize that the characteristics of the cartridge and the image forming apparatus are not coincident with each other.

Even in the case where the first convex portion does not press the switch, since it is fitted in the other first concave portion, there is no fear that it is broken by receiving forcible force at the time of loading, or the cartridge or the image forming apparatus is damaged.

Figure 4:
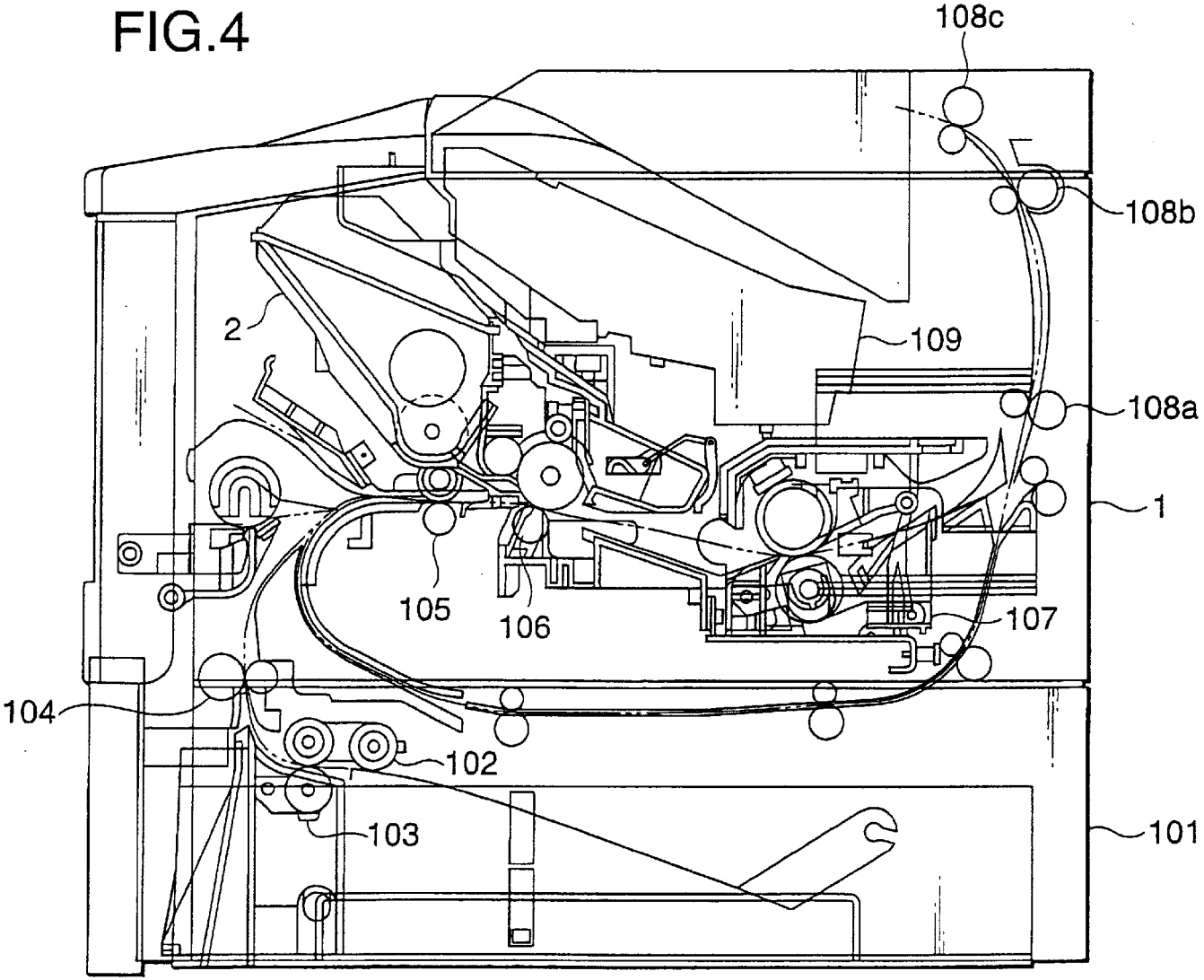
FIG. 4 is a view for explaining the whole structure of an image forming apparatus of an embodiment.

FIG. 4 is a view for explaining the whole structure of an image forming apparatus according to the embodiment. This image forming apparatus is roughly constructed by an image forming apparatus main body (hereinafter, there is a case where it is referred to as merely "a main body") 1 and a process cartridge (hereinafter, there is a case where it is simply referred to as "a cartridge") 2 detachably attached to the main body 1. The image forming apparatus main body 1 includes a sheet tray 101, a pickup roll 102, conveying rolls 104, and 108*a* to 108*c*, a registration roll 105, a transfer roll 106, a fixing unit 107, an ROS unit 109, and the like.

An image forming operation of this image forming apparatus will be described in brief. On the basis of an image forming signal transmitted from a personal computer or the like external to the image forming apparatus, the ROS unit 109 writes a latent image on a photoreceptor drum in the process cartridge 2. The latent image is revealed with toner, the toner image is held on the photoreceptor drum, and is rotated and moved to a position (transfer position) opposite to the transfer roll 106. On the other hand, a recording sheet is taken out of the sheet tray 101 one by one by the pickup roll 102, and is conveyed to the registration roll 105 by the conveying roll 104. The registration roll 105 rotates at the timing when the toner image on the photoreceptor drum reaches the transfer position, and conveys the recording sheet to the transfer position.

At the transfer position, the toner image is electrostatically transferred from the photoreceptor drum to the recording sheet. The recording sheet holding the transferred toner image on its surface passes through the fixing unit 107. In the fixing unit 107, when the toner image passes through a nip portion between a heating roll and a pressurizing roll, it is fixed to the recording sheet by the heat and pressure, and becomes an eternal image. Thereafter, the recording sheet is conveyed by the conveying rolls 108*a* to 108*c* and is discharged from a discharge port of the image forming apparatus.

Figure 5:
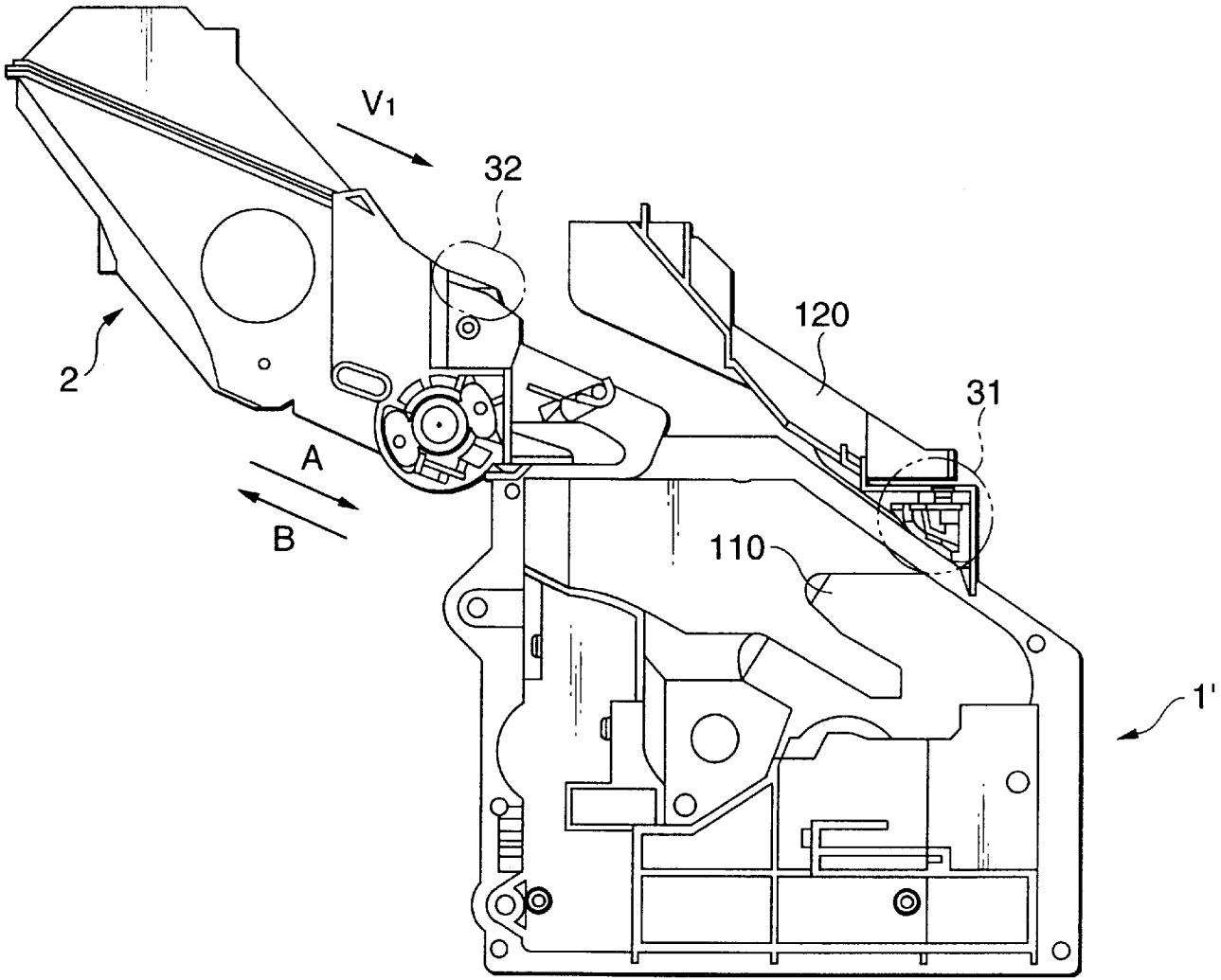
FIG. 5 is a view for explaining an attachment/detachment operation between an image forming apparatus main body and a cartridge.

FIG. 5 is a view for explaining an attachment/detachment operation of the image forming apparatus main body 1 and the cartridge 2. The drawing shows only a framework portion 1' of the image forming apparatus main body 1.

This image forming apparatus main body 1 (framework portion 1') includes a side guide 110 and an upper guide 120 for loading the cartridge 2 to a predetermined position of the main body 1. Besides, the main body 1 (framework portion 1') and the cartridge 2 respectively include a main body side discriminating portion 31 and a cartridge side discriminating portion 32 to discriminate the mechanical compatibility. The main body side discriminating portion 31 and the cartridge side discriminating portion 32 are provided at a position where they are opposite to each other in a loaded state. Incidentally, arrow A in the drawing indicates a loading direction of the cartridge 2, and arrow B in the drawing indicates a detaching direction of the cartridge 2.

Figure 6:
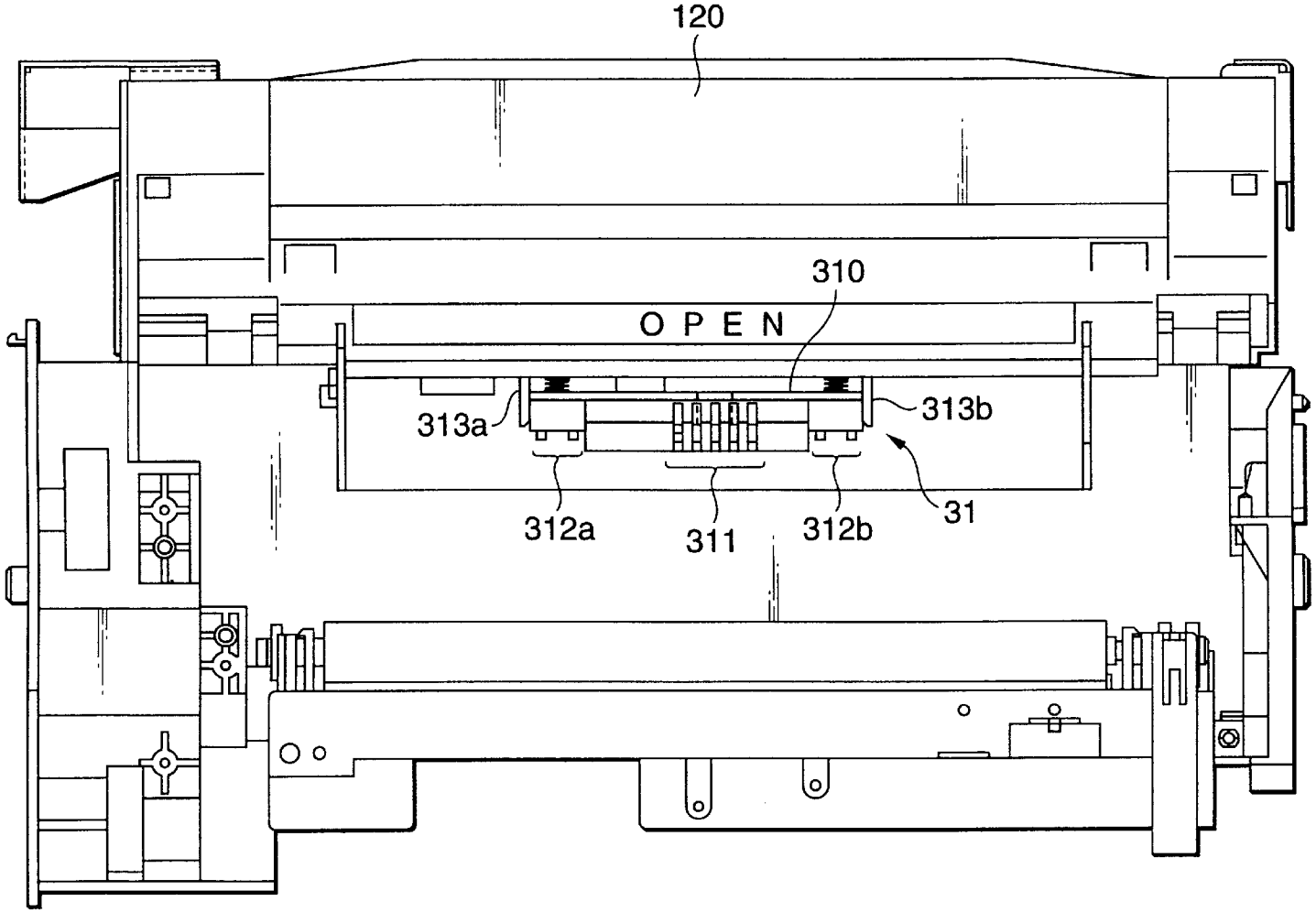
FIG. 6 is a view of the image forming apparatus main body seen in the direction of arrow $V_1$ of FIG. 5.
Figure 7A:
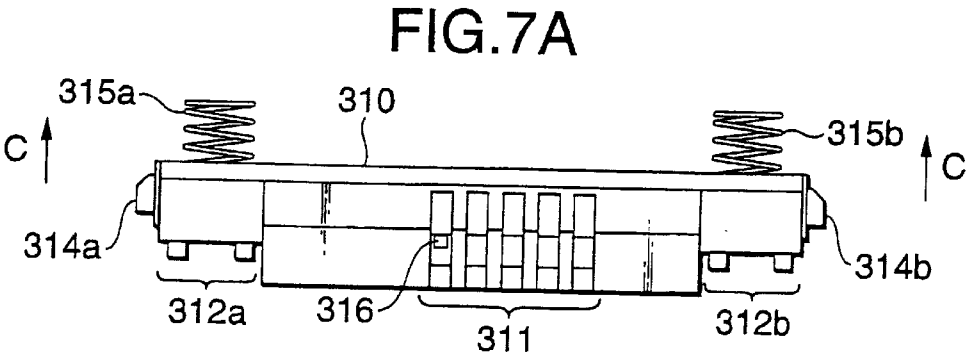
FIGS. 7A to 7E are views for explaining the structure of a discriminating portion at a main body side in detail.
Figure 7B:
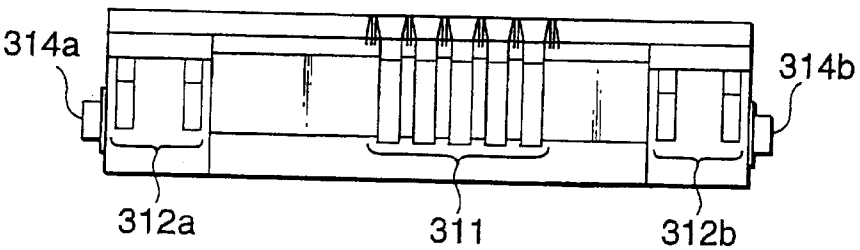
Figure 7C:
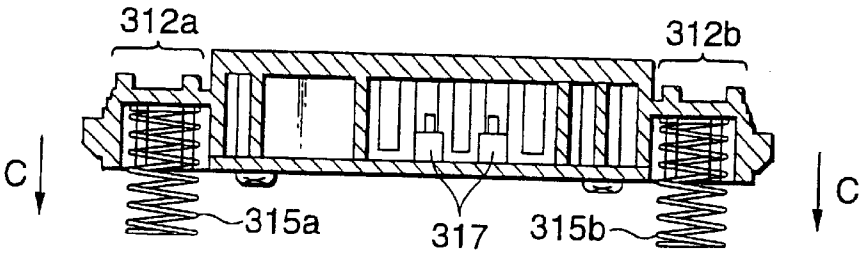
Figure 7D:
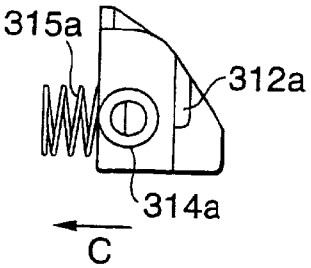
Figure 7E:
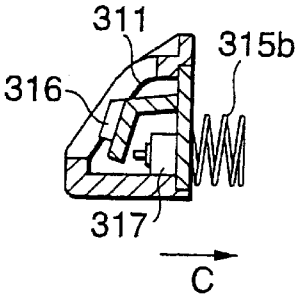

FIG. 6 is a view showing the main body 1 seen in the direction of arrow $V_1$ in FIG. 5. FIGS. 7A to 7E are views for explaining the main body side discriminating portion 31 in more detail. FIG. 7A shows a side portion of the main body side discriminating portion 31, FIG. 7B shows its upper portion, FIG. 7C shows a section of the side portion, FIG. 7D shows another side portion, and FIG. 7E shows a section of the other side portion, respectively. On the basis of FIGS. 6 and FIGS. 7A to 7E, the structure of the main body side discriminating portion 31 will be described in detail.

The main body discriminating portion 31 is constructed by a holder 310, holder springs 315*a* and 315*b* one end of each of which is fixed to the image forming apparatus main body 1 and the other end is fixed to the holder, holder shafts 314*a* and 314*b* fixed to both ends of the holder 310, and holder bearings 313*a* and 313*b* for holding the holder shafts 314*a* and 314*b*. The holder 310 includes, as a second discriminating unit, main body side second concave-convex portions 312*a* and 312*b* of a pattern according to the characteristics of the image forming apparatus main body 1. Further, the holder includes, as a first discriminating unit, plural first concave portions 311, an actuator (switch button, fitted portion) 316 provided at a position according to the characteristics of the image forming apparatus main body 1 among those plural first concave portions, and an electrical switch 317 which is turned on by pressing the actuator 316. The plural first concave portions 311 are shaped into slit holes of long length in the attachment/detachment direction (see the arrows A and B in FIG. 5) of the image forming apparatus main body 1 and the cartridge 2.

Here, this holder 310 can be freely retracted along the holder bearings 313*a* and 313*b* from the side of the cartridge to the side of the image forming apparatus main body. Arrow C in FIGS. 7A to 7E indicates the retracting direction of the holder 310. By the action of the holder springs 315*a* and 315*b*, the holder 310 is urged from the side of the image forming apparatus main body to the side of the cartridge. Incidentally, the urging direction (and the retracting direction of the holder 310) is substantially coincident with the concave-convex direction of the main body side second concave-convex portions 312*a*, 312*b* and the plural first concave portions 311.

Figure 8:
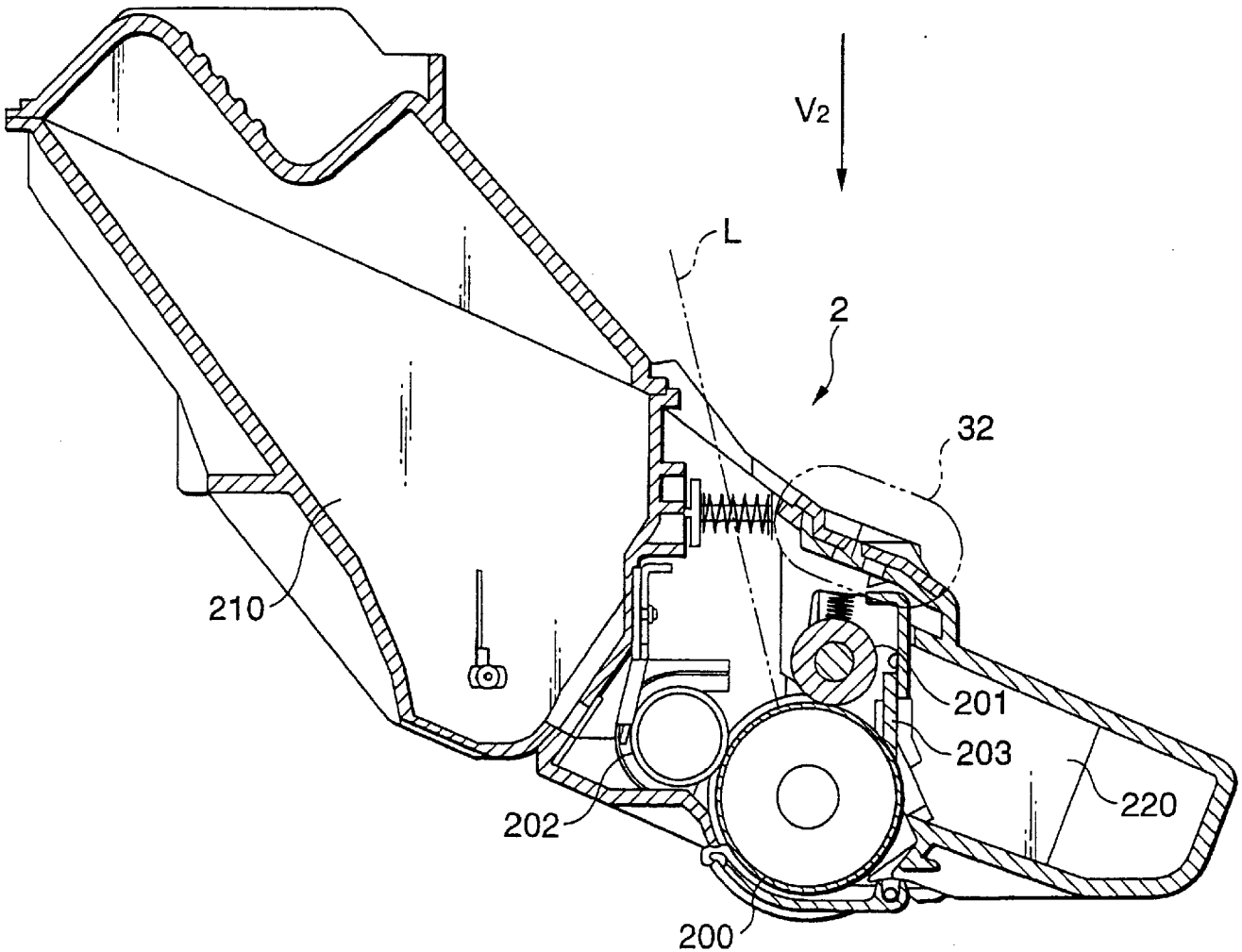
FIG. 8 is a view for explaining the structure of a cartridge in detail.

FIG. 8 is a sectional view for explaining the structure of the cartridge 2 in more detail. This process cartridge 2 includes, as a structure around a photoreceptor, a photoreceptor drum 200 on which a latent image and a revealed image with toner are formed and held, an electrifying roll 201 for uniformly electrifying the surface of the photoreceptor drum 200 in its longitudinal direction, a developing roll 202 for developing the latent image, which is formed on the surface of the photoreceptor drum 200 through a potential difference, by toner, and a cleaner blade 203 for scraping off the toner or the like remaining on the surface of the photoreceptor drum 200 after transferring.

Besides, the cartridge 2 includes a first space portion 210 and a second space portion 220. The first space portion 210 is filled with a developer in a non-use state. The second space portion 220 is a space for storing the toner scraped by the cleaner blade 203 in a use state. Incidentally, the latent image on the surface of the photoreceptor drum 200 is formed by laser light L from the ROS unit 109 included in the image forming apparatus main body 1 shown in FIG. 4.

Figure 9:
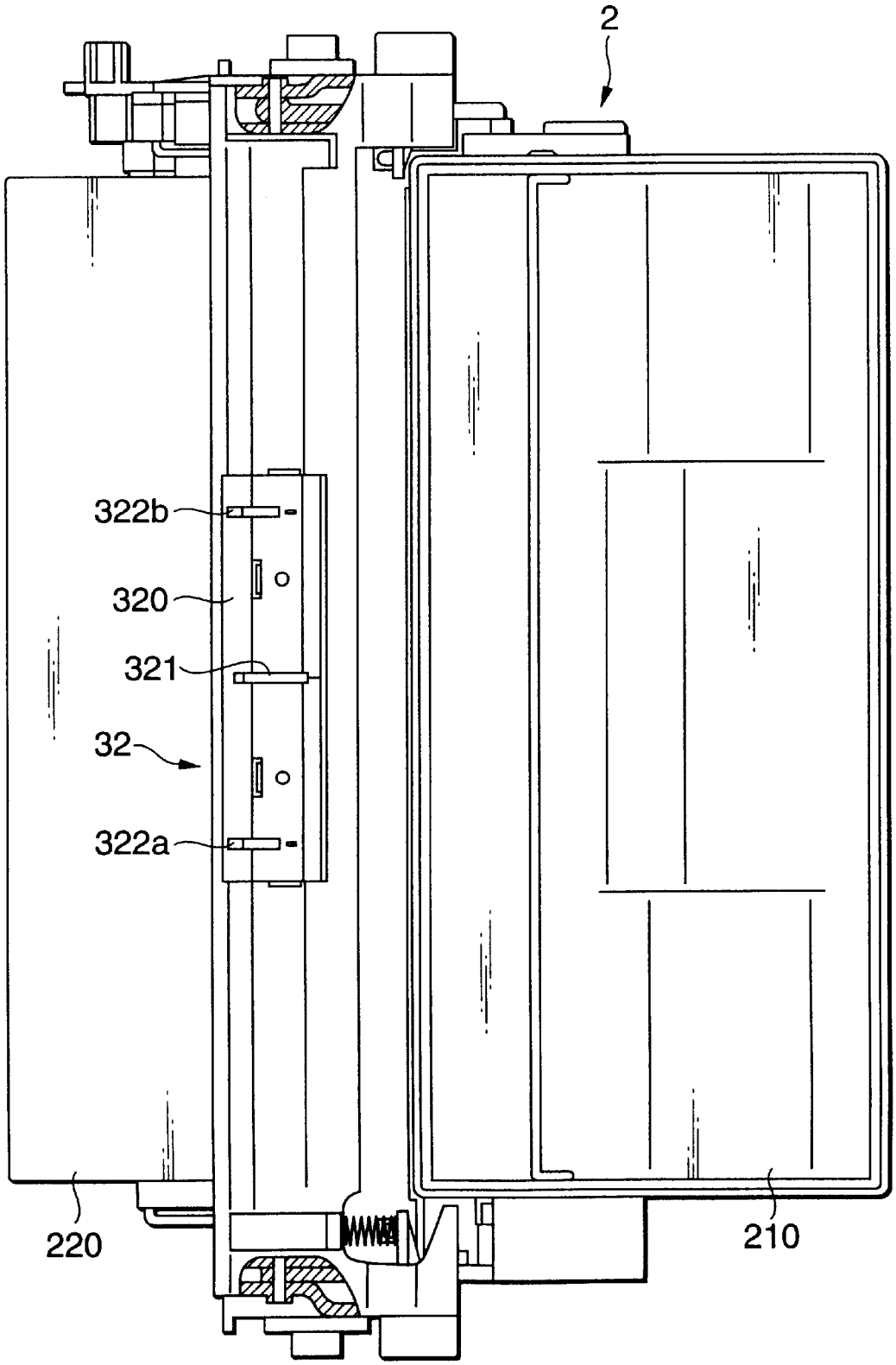
FIG. 9 is a view of the cartridge seen in the direction of arrow $V_2$ of FIG. 8.

FIG. 9 shows the cartridge 2 seen in the direction of arrow $V_2$ in FIG. 8. Here, the cartridge side discriminating portion 32 is constructed by a key plate 320 attached as a separate component from the main body of the cartridge 2, a first convex portion (fitting portion) 321 provided as the first discriminating unit at a position on the key plate 320 according to the characteristics of the cartridge 2, and cartridge side second concave-convex portions 322*a* and 322*b* similarly provided as the second discriminating unit at positions on the key plate 320 according to the characteristics of the cartridge 2. Incidentally, the first convex portion 321 is a projecting portion of long length in the direction of attachment/detachment (see the arrows A and B in FIG. 5) of the image forming apparatus main body 1 and the cartridge 2.

Figure 10:
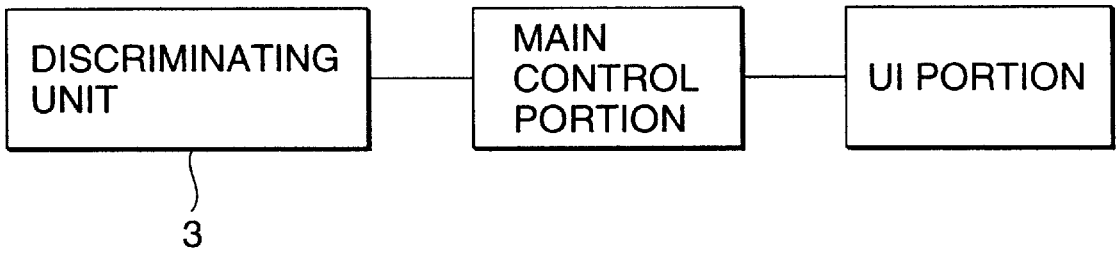
FIG. 10 is a block diagram for explaining the function to discriminate the cartridge.

FIG. 10 is a functional block diagram for explaining the structure to perform discrimination of the mechanical compatibility of the cartridge in the image forming apparatus of this embodiment and the subsequent processing. Here, the drawing shows a discriminating unit 3 including the main body side discriminating portion 31 and the cartridge side discriminating portion 32, a main control portion for receiving discrimination information from the discriminating unit 3, for controlling an image forming operation according to the mechanical compatibility of the cartridge 2, and for causing an after-mentioned user interface (UI) to perform suitable display, and a UI portion for displaying information to a user by instructions from the main control portion.

Figure 11:
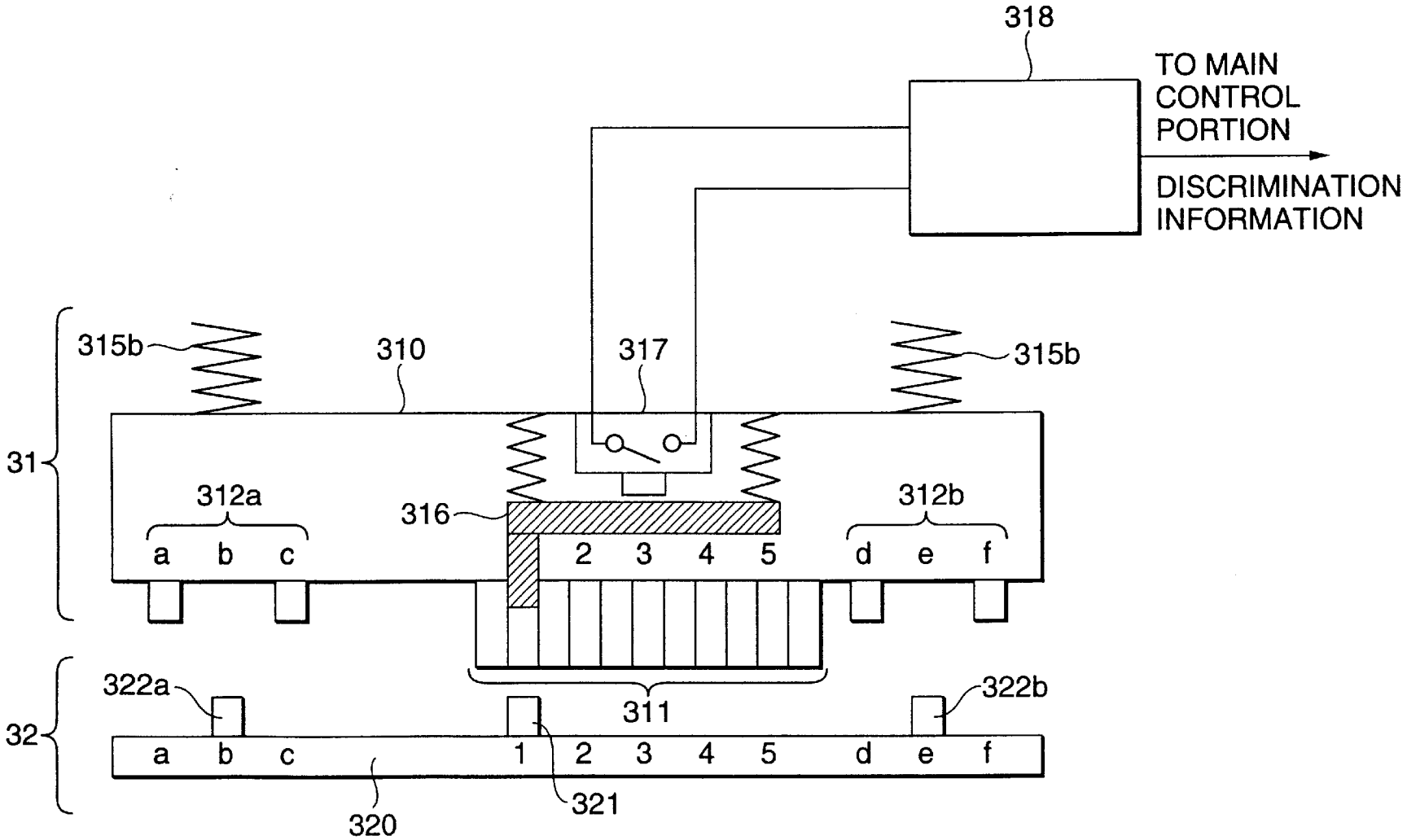
FIG. 11 is a view for schematically showing the structure of a discriminating unit.
Figure 12A:
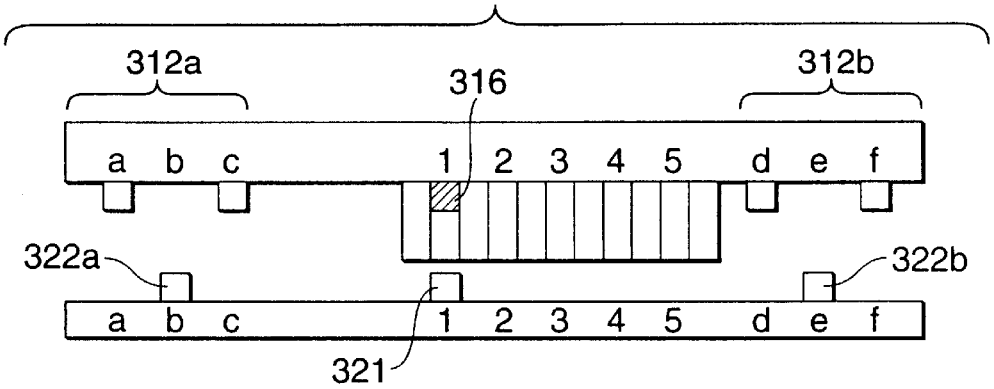
FIGS. 12A to 12D are views for schematically showing modes of first and second discriminating units in the case where the characteristics of the image forming apparatus main body and the cartridge conform to each other.
Figure 12B:
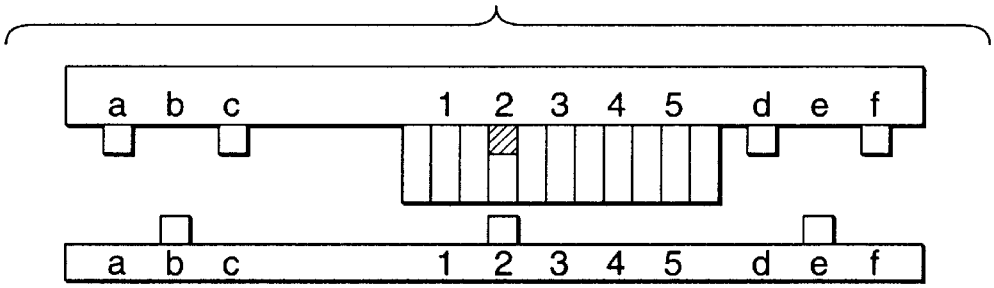
Figure 12C:
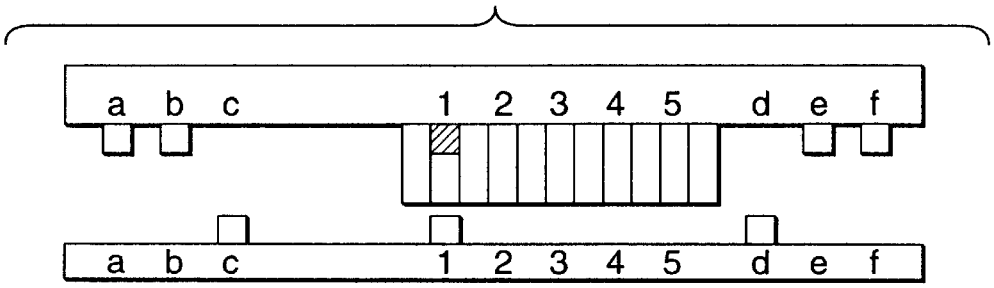
Figure 12D:
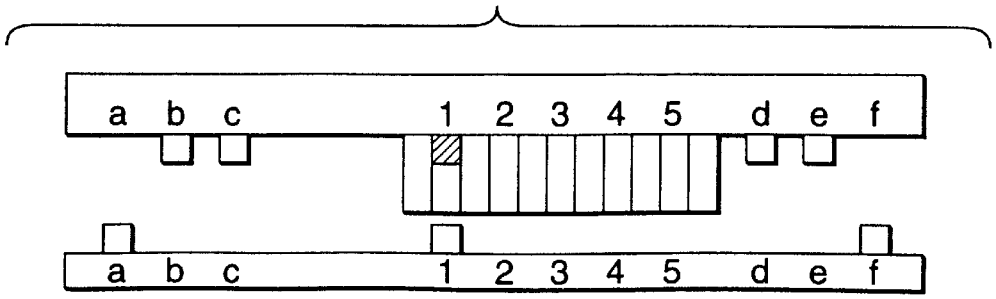

FIG. 11 shows the structure of the discriminating unit 3 shown in FIG. 10, that is, schematically shows the structure of the periphery of the holder 310 and the key plate 320. The discriminating unit includes a discriminating circuit 318 for transmitting output from the switch 317 to the main control portion of the image forming apparatus as discrimination information. With respect to the other components, the same components as those explained in FIGS. 6, 7A to 7E and 9 are designated by the same characters and their description will be omitted.

As shown in this drawing, the plural first concave portions 311 constructing the first discriminating unit include five concave portions. Symbols of 1 to 5 are given to these five concave portions for convenience, and according to the characteristics of the image forming apparatus main body 1, the actuator 316 is provided in one specific concave portion (here, No. 1) among the five concave portions.

Similarly, there are five positions where the first convex portion 321 constructing the first discriminating unit can be provided, and symbols of 1 to 5 are given to those positions for convenience. According to the characteristics of the cartridge 2, the first convex portion 321 is provided at one specific position (here, No. 1) among the five positions where the first convex portion 321 can be provided.

On the other hand, in one (312*a* or 312*b*) of the main body side second concave-convex portions 312*a* and 312*b* constructing the second discriminating unit, there are three positions where the convex portion can be provided, and symbols of a to c (or d to f) are given to those positions for convenience. According to the characteristics of the image forming apparatus main body 1, the convex portions are provided at specific two positions (here, positions a and c, or d and f) among these three positions where the convex portion can be provided.

Similarly, in one (322*a* or 322*b*) of the cartridge side second concave-convex portions 322*a* and 322*b* constructing the second discriminating unit, there are three positions where the convex portion can be provided, and symbols of a to c (or d to f) are given to those positions for convenience. According to the characteristics of the cartridge 2, the convex portion is provided at one specific position (here, position b or e) among these three positions where the convex portion can be provided.

Incidentally, in this embodiment, the concave-convex pattern of the one main body side second concave-convex portion 312*a* is the same as that of the other main one cartridge side second concave-convex portion 312*b*, and the concave-convex pattern of the one cartridge side second concave-convex portion 322*a* is the same as that of the other cartridge side second concave-convex portion 322*b*.

Hereinafter, a description will be made on how to discriminate the mechanical compatibility between the image forming apparatus main body 1 and the cartridge 2 by the first discriminating unit and the second discriminating unit.

TABLE 1

| | |
|---|---|
| 1 | CRU side key |
| 2 | electrical key contact |
| 3 | mechanical key |
| 4 | IOT side key |
| 5 | electrical key contact |
| 6 | mechanical key |

Table 1 shows the combinations of the first and second discriminating units in the case where the characteristics of the image forming apparatus main body 1 and the cartridge 2 conform to each other. Key numbers of F-1 to F-5, G-1 to G-5, and H-1 to H-5 are given to these combinations for convenience. The table shows the combinations of the electrical key contact and mechanical key as the CRU side key, and the electrical key contact and mechanical key as the IOT side key. Incidentally, the CRU side key indicates the cartridge side discriminating portion 32, the IOT side key indicates the main body side discriminating portion 31, the electrical key contact indicates the first discriminating unit, and the mechanical key indicates the second discriminating unit.

FIGS. 12A to 12D schematically show several modes of the first and second discriminating units in the case where the characteristics of the image forming apparatus main body 1 and the cartridge 2 conform to each other. Here, FIG. 12A corresponds to F-1 of Table 1, FIG. 12B corresponds to F-2 of Table 1, FIG. 12C corresponds to G-1 of Table 1, and FIG. 12D corresponds to H-1 of Table 1, respectively. For example, in FIG. 12A, the positions of the actuator 316 and the first convex portion 321, as the first discriminating unit, are coincident with each other (both are No. 1), and the mutual irregularities of the main body side second concave-convex portions 312*a* and 312*b* and the cartridge side second concave-convex portions 322*a* and 322*b*, as the second discriminating unit, can be fitted to each other.

Figure 13A:
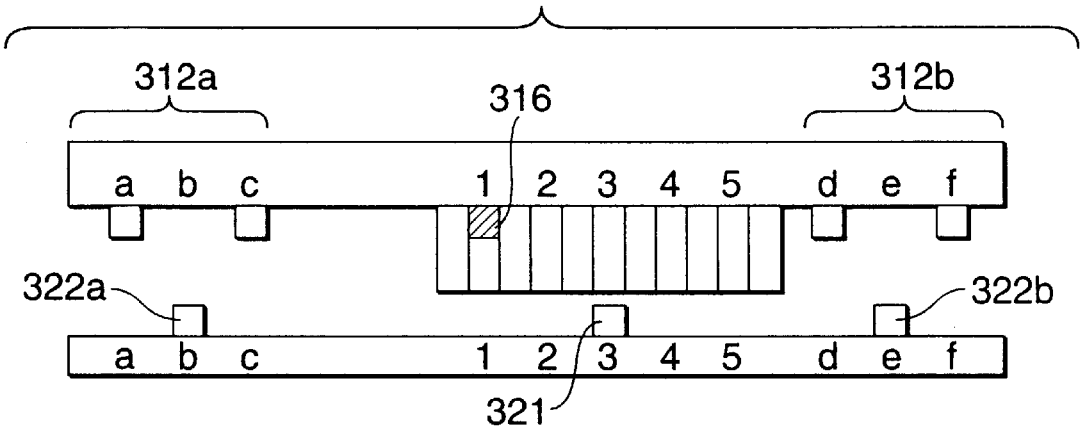
FIGS. 13A to 13C are views for schematically showing modes of the first and second discriminating units in the case where the characteristics of the image forming apparatus main body and the cartridge do not conform to each other.
Figure 13B:
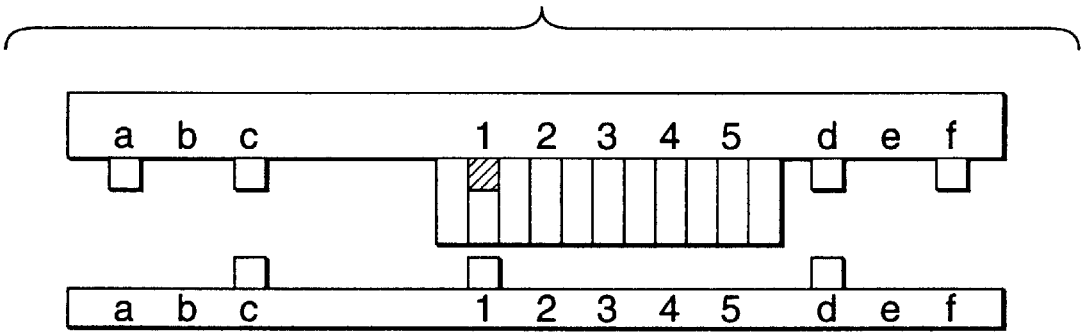
Figure 13C:
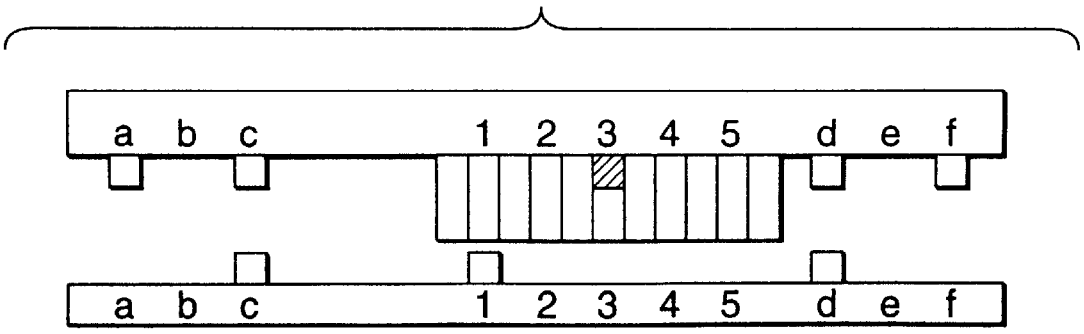

On the contrary, FIGS. 13A to 13C schematically show three modes of the first and second discriminating units in the case where the characteristics of the image forming apparatus main body 1 and the cartridge 2 do not conform to each other. Here, FIG. 13A shows a mode in which although the second discriminating unit can fit in, the first discriminating unit is not coincident, FIG. 13B shows a mode where although the first discriminating unit is coincident, the second discriminating unit can not fit in, and FIG. 13C shows a mode where the first discriminating unit is not coincident and the second discriminating unit can not fit in as well.

That is, in FIG. 13A, the positions of the actuator 316 and the first convex portion 321, as the first discriminating unit, are No. 1 and No. 3 and are not coincident to each other, while the mutual irregularities of the main body side second concave-convex portions 312*a* and 312*b* and the cartridge side second concave-convex portions 322*a* and 322*b*, as the second discriminating unit, can be fitted to each other.

In FIG. 13B, the positions of the actuator 316 and the first convex portion 321, as the first discriminating unit, are coincident with each other (both are No. 1), while the mutual irregularities of the main body side second concave-convex portions 312*a* and 312*b* and the cartridge side second concave-convex portions 322*a* and 322*b*, as the second discriminating unit, can not be fitted to each other (the convex portions at the positions c and d interfere with each other).

In FIG. 13C, the positions of the actuator 316 and the first convex portion 321, as the first discriminating unit, are No. 3 and No. 1 and are not coincident with each other, and the mutual irregularities of the main body side second concave-convex portions 312*a* and 312*b* and the cartridge side second concave-convex portions 322*a* and 322*b*, as the second discriminating unit, can not be fitted to each other (the convex portions at the positions c and d interfere with each other).

Figure 14C:
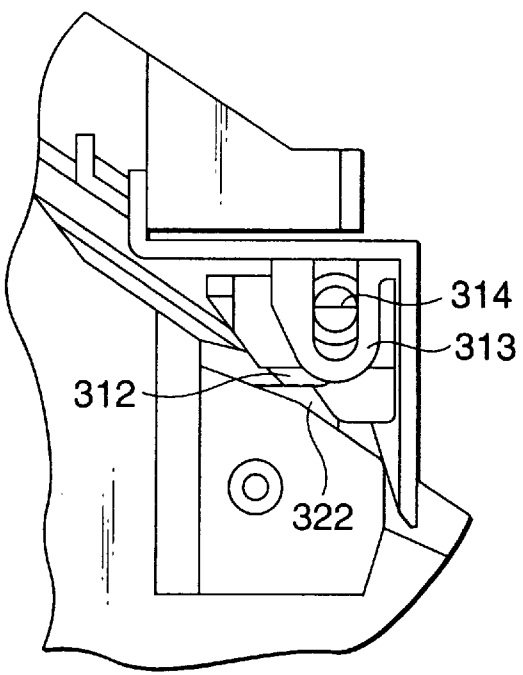
FIGS. 14A to 14C are views for showing modes of a main body side discriminating portion and a cartridge side discriminating portion in the case where the characteristics of the image forming apparatus main body and the cartridge conform to each other and in the case where they do not conform to each other.
Figure 14B:
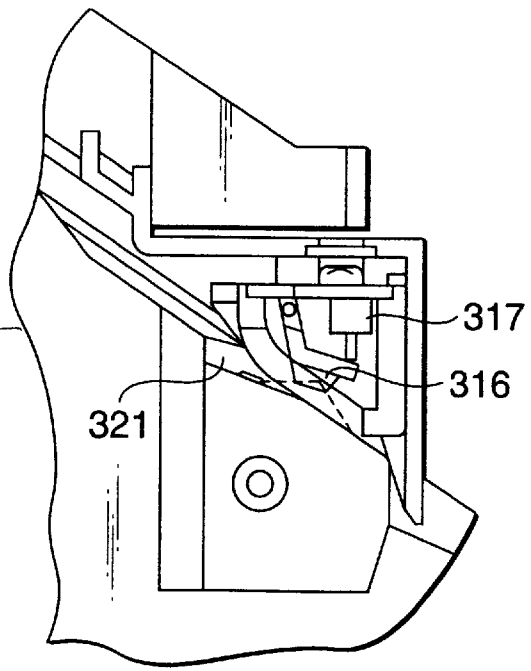
Figure 14A:
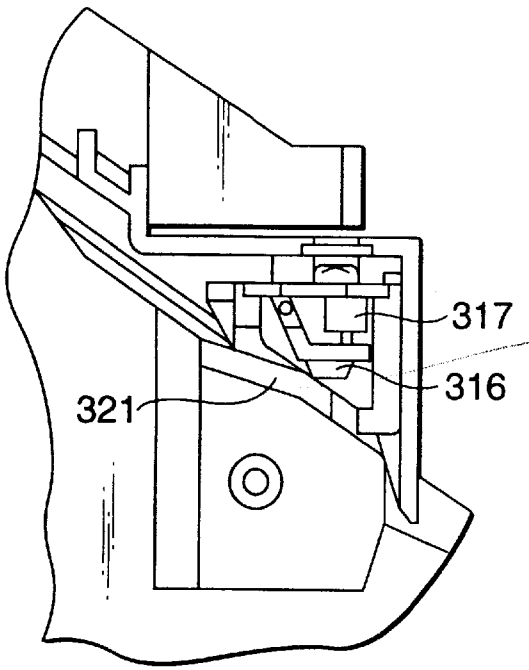

FIGS. 14A to 14C are views for explaining the loaded state of the vicinity of the main body side discriminating portion 31 and the cartridge side discriminating portion 32 in each mode of the first and second discriminating units shown in FIGS. 12A to 12D and FIGS. 13A to 13C. FIG. 14A shows a case where the characteristics of the image forming apparatus main body 1 and the cartridge 2 conform to each other (the modes shown in FIGS. 12A to 12D), and FIGS. 14B and 14C show cases where the characteristics of the image forming apparatus main body 1 and the cartridge 2 do not conform to each other. FIG. 14B shows the case where the second discriminating unit fits in (the mode shown in FIG. 13A), and FIG. 14C shows the case where the second discriminating unit does not fit in (the mode shown in FIG. 13B or 13C).

That is, in FIG. 14A, since the mutual irregularities of the main body side second concave-convex portions 312*a* and 312*b* and the cartridge side second concave-convex portions 322*a* and 322*b*, as the second discriminating unit, can be fitted to each other, the holder 310 is urged by the holder springs 315*a* and 315*b* from the main body side to the cartridge side, and the actuator 316 as the first discriminating unit is in the state where it can be pressed by the first convex portion 321. Further, since the positions of the actuator 316 and the first convex portion 321 are coincident with each other, the actuator 316 is pressed by the first convex portion 321.

Then, the switch 317 is turned on, the electricity is supplied to the discriminating circuit 318, and the discrimination information indicating "conformity" is transmitted from the discriminating circuit 318 to the main control portion of the image forming apparatus. Then, the main control portion recognizes that the suitable cartridge 2 is loaded, and enables image formation (see FIG. 10 and FIG. 11).

In FIG. 14B, since the mutual irregularities of the main body side second concave-convex portions 312*a* and 312*b* and the cartridge side second concave-convex portions 322*a* and 322*b*, as the second discriminating unit, can be fitted to each other, the holder 310 is urged from the main body side to the cartridge side by the holder springs 315*a* and 315*b*, and the actuator 316 as the first discriminating unit is in the state where it can be pressed by the first convex portion 321. However, since the positions of the actuator 316 and the first convex portion 321 are not coincident with each other, the actuator 316 is not pressed by the first convex portion 321.

Thus, the switch 317 is not turned on, the electricity is not supplied to the discriminating circuit 318, and the discrimination information indicating "nonconformity" is transmitted from the discriminating circuit 318 to the main control portion of the image forming apparatus. Then, the main control portion can not recognize that a suitable cartridge 2 is loaded, and causes the U1 portion to display the information, for example, "suitable cartridge is not loaded" (see FIG. 10, FIG. 11).

In FIG. 14C, since the mutual irregularities of the main body side second concave-convex portions 312*a* and 312*b* and the cartridge side second concave-convex portions 322*a* and 322*b*, as the second discriminating unit, can not be fitted to each other, both the second concave-convex portions 312*a*, 312*b*, 322*a*, and 322*b* interfere with one another, the holder 310 is retracted from the cartridge side to the main body side against the urging force by the holder springs 315*a* and 315*b*, and the actuator 316 as the first discriminating unit is not in the state where it can be pressed by the first convex portion 321.

Thus, the switch 317 is not turned on, the electricity is not supplied to the discriminating circuit 318, and the discrimination information indicating "nonconformity" is transmitted from the discriminating circuit 318 to the main control portion of the image forming apparatus. Then, the main control portion can not recognize that a suitable cartridge 2 is loaded, and causes the UI portion to display the information, for example, "suitable cartridge is not loaded" (see FIG. 10, FIG. 11).

As described above in detail, the present invention can provide an image forming apparatus which can discriminate the kinds of many cartridges through a small and simple structure.

What is claimed is:

1. An image forming apparatus comprising an image forming apparatus main body, a cartridge detachably attached to the image forming apparatus main body, and a discriminating unit which discriminates mechanical compatibility between the cartridge and the image forming apparatus main body, wherein the discriminating unit comprises:

a first discriminating unit which discriminates the mechanical compatibility by defining a positional relation between a fitting portion provided at a predetermined position at a side of the cartridge and a fitted portion provided at a predetermined position at a side of the image forming apparatus main body on a fitting surface in a loaded state according to characteristics of the cartridge and characteristics of the image forming apparatus main body; and a second discriminating unit which discriminates the mechanical compatibility by defining a positional relation between the fitting portion and the fitted portion in the loaded state in a fitting direction according to the characteristics of the cartridge and the characteristics of the image forming apparatus main body.

2. An image forming apparatus according to claim 1, wherein the first discriminating unit comprises:

plural first concave portions provided at the side of the image forming apparatus main body;

a switch button provided as the fitted portion in one of the plural first concave portions according to the characteristics of the image forming apparatus main body; and a first convex portion provided as the fitting portion at the side of the cartridge and being capable of fitting to one of the plural first concave portions provided at the side of the image forming apparatus main body according to the characteristics of the cartridge.

3. An image forming apparatus according to claim 2, wherein the first concave portions are slit holes of long length in an attaching/detaching direction of the image forming apparatus main body and the cartridge, and the first convex portion is a projecting portion of long length in the attaching/detaching direction of the image forming apparatus main body and the cartridge.

4. An image forming apparatus according to claim 1, wherein the second discriminating unit comprises a main body side second concave-convex portion provided at the side of the image forming apparatus main body according to the characteristics of the image forming apparatus main body, and a cartridge side second concave-convex portion provided at the side of the cartridge according to the characteristics of the cartridge, and wherein at least in a case where the characteristics of the image forming apparatus main body and the cartridge are coincident with each other, both the second concave-convex portions are fitted to each other.

5. An image forming apparatus according to claim 4, wherein the main body side second concave-convex portion is freely retracted in a concave-convex direction with respect to the cartridge and is urged to the side of the cartridge.

6. An image forming apparatus according to claim 5, wherein the plural first concave portions and the main body side second concave-convex portion are integrally constructed.

7. A cartridge of an image forming apparatus, loaded in the image forming apparatus according to claim 1.

8. An image forming apparatus according to claim 1, wherein the first discriminating unit provided at the predetermined position at the side of the cartridge and the second discriminating unit are provided on a same member.

9. An image forming apparatus according to claim 1, wherein the first discriminating unit provided at the predetermined position at the side of the image forming apparatus main body and the second discriminating unit are provided on a same member.

10. An image forming apparatus according to claim 1, wherein the second discriminating unit is dividedly disposed at both sides of the first discriminating unit.

* * * * *